US005662220A

United States Patent [19]

Schurman

[11] Patent Number: 5,662,220

[45] Date of Patent: Sep. 2, 1997

[54] CASE

[75] Inventor: Peter T. Schurman, Woodbridge, Conn.

[73] Assignee: The Plastic Forming Company, Inc., Woodbridge, Conn.

[21] Appl. No.: 620,459

[22] Filed: Mar. 22, 1996

[51] Int. Cl.[6] ..... A45C 11/26

[52] U.S. Cl. ..... 206/349; 206/317; 206/525

[58] Field of Search ..... 206/525, 349, 206/317

[56] References Cited

U.S. PATENT DOCUMENTS

| | | | |
|---|---|---|---|
| 2,781,897 | 2/1957 | Dale | 206/317 |
| 2,788,889 | 4/1957 | Turnbow | 206/349 |
| 3,908,824 | 9/1975 | Takahara et al. | 206/312 |
| 4,369,575 | 1/1983 | Schurman | 206/349 |
| 4,371,079 | 2/1983 | Dembicks | 206/349 |
| 5,119,937 | 6/1992 | Reynolds, Jr. | 206/349 |
| 5,476,173 | 12/1995 | Opresco | 206/309 |
| 5,533,843 | 7/1996 | Chung | 206/349 |

FOREIGN PATENT DOCUMENTS

| | | | |
|---|---|---|---|
| 0273808 | 7/1988 | European Pat. Off. | 206/349 |
| 362031078 | 2/1987 | Japan | 206/308.1 |

*Primary Examiner*—Paul T. Sewell
*Assistant Examiner*—Nhan T. Lam
*Attorney, Agent, or Firm*—Bachman & LaPointe, P.C.

[57] ABSTRACT

A case for holding an elongated object is provided. The case includes a first containment portion for containing at least a first portion of the object. The first containment portion includes a door for exposing at least the first portion of the object. A second containment portion for containing at least a second portion of the object is also provided. The second containment portion is pivotally connected to the first containment portion and thereby pivotal relative the first containment portion through an angle having a magnitude for allowing clearance of the first portion from the first containment portion for allowing removal of the object from the first and second containment portions.

25 Claims, 2 Drawing Sheets

CASE

BACKGROUND OF THE INVENTION

This invention is directed to cases, and more particularly, to a more simply and economically constructed case for holding an object having an elongated body portion.

Cases for housing elongated objects typically include an elongated base portion for cradling the object and an elongated door portion, hinged to the base portion, for exposing the object for removal. Such a design typically requires an expensive molding process which requires a large mold for forming separately or unitarily the elongated base portion and the elongated door portion. Molding can be more or less complex depending upon the overall shape of the case.

For example, the elongated object typically has a large handle portion with a relatively narrow elongated portion, such as, a rifle, metal detector, torque wrench or chain saw. In these cases, the entire length of the case may be designed to have a uniform width for accommodating a less complex hinge and door design, in which case wasted material is necessarily used in the containment portion for housing the elongated body portion of the object. Optionally, a narrower portion may be used for the hinged door for the elongated portion of the object. This design, however, requires a separate hinged area at the elongated portion, causing the molding process to be even more complex.

For these cases, either too much material is used or an overly complicated design is required, thereby elevating the expense of the case. The prior art does include several plastic cases directed for use with elongated objects, one of which is described below.

For example, U.S. Pat. No. 5,002,185 to Schurman discloses a hinged cover for a hard plastic golf bag. The patent is directed to light weight travel golf bags formed from a rigid plastic for providing protection to the golf clubs, particularly during transport. The plastic golf bag includes a hard plastic cover which is adapted to protect the heads of the golf clubs, also during transport. Previous to this design, light weight bags were formed from nylon and their covers as well were formed from nylon, thereby not providing the desired protection.

In Schurman, a cover is hinged to the upper end of the elongated body portion of the bag. The cover includes a spine hinged to the upper end and with the cover in the protective position, the spine extends upwardly. The cover also includes two outwardly pivotal door panels which allow the cover to be disconnected from the top end of the golf bag everywhere except at a sliding pivot point on the spine. Once the door panels are opened, the cover may be rotated through approximately 180° on the sliding pivot for moving the cover downward and substantially parallel to the main body portion of the bag. Once in this position, the door panels may again be closed. Accordingly, a receptacle is formed by the cover for placement therein of gloves, balls or other items.

In the above described manner, the cover remains attached to the golf bag and does not have to be carted separately or otherwise stored before use. The complexity of the bag and sliding pivot is obvious from the drawings shown therein. Due to the frequent need to remove clubs from and insert clubs in the bag, the cover must be moved entirely out of the way of the club heads thereby necessitating a 180° pivot range. Accordingly, the complex hinged door panel design is used for allowing such movement of the cover.

Scabbards are known to exist for chain saws. The scabbards are blow molded single walled sheaths which surround and house the chain and bar portion of the chain saw. Chain saw cases which accept such scabbards are known to exist. These cases typically include, at one end, a slot at the case parting line, into which the bar and chain portions of the saw, encased in the scabbard, is inserted. When the case is opened and the chain saw removed, the scabbard is also removed from the case since it remains attached to the bar and chain portions. This construction is useful for chain saws, since it affords protection from the sharp teeth of the chain saw even when the saw is not enclosed in its case. This design, however, makes the saw package non-unitary and in so doing increases the awkwardness of handling and the likelihood that the scabbard portion may become lost. Accordingly, unless the scabbard encloses a hazardous object, these known scabbards are not suitable for providing the level of convenience sought after and acquired using the case of the present invention.

Additional cases are shown in U.S. Pat. Nos. 3,795,265 and 3,828,969 and 3,327,841 all to Schurman. Each of these cases, however, are not directed for use with elongated objects. Accordingly, these cases do not accomplish easing the removal of elongated objects from cases as sought after in this invention.

There exists, therefore, a need for a case specifically designed for elongated articles which allows for a simple structure as well as ease of removal of elongated body portions of objects from the case.

SUMMARY OF THE INVENTION

The primary object of this invention is to provide a case for protectively housing elongated objects, which case allows for the easy removal of an elongated body portion of the object therefrom.

Another object of this invention is to provide a case for elongated objects, which case allows for easy removal of elongated body portions of objects therefrom while having a design for minimizing costs associated with molding such cases.

Still another object of this invention is to provide an elongated case having two relatively movable containment portions so as to allow for easy removal of elongated body portions of objects therefrom.

And still another object of this invention is to provide a case for elongated objects which case includes one containment portion for receiving the main body portion of an object and another containment portion for receiving an elongated body portion of an object, wherein only one of the containment portions includes a hinged door panel for exposing the object.

The objects and advantages set forth are achieved by the case of the present invention used for holding an object. The case comprises a first containment means for containing at least a first portion of the object. The first containment means includes means for exposing at least the first portion of the object. A second containment means for containing at least a second portion of the object is also provided. The second containment means is pivotally connected to said first containment means and thereby pivotal relative said first containment means through an angle having a magnitude for allowing clearance of said first portion from said first containment means for allowing removal of said object from said first and second containment means.

The details of the present invention are set out in the following description and drawings wherein like reference characters depict like elements.

DETAILED DESCRIPTION OF THE PREFERRED EMBODIMENT

Figure 1:
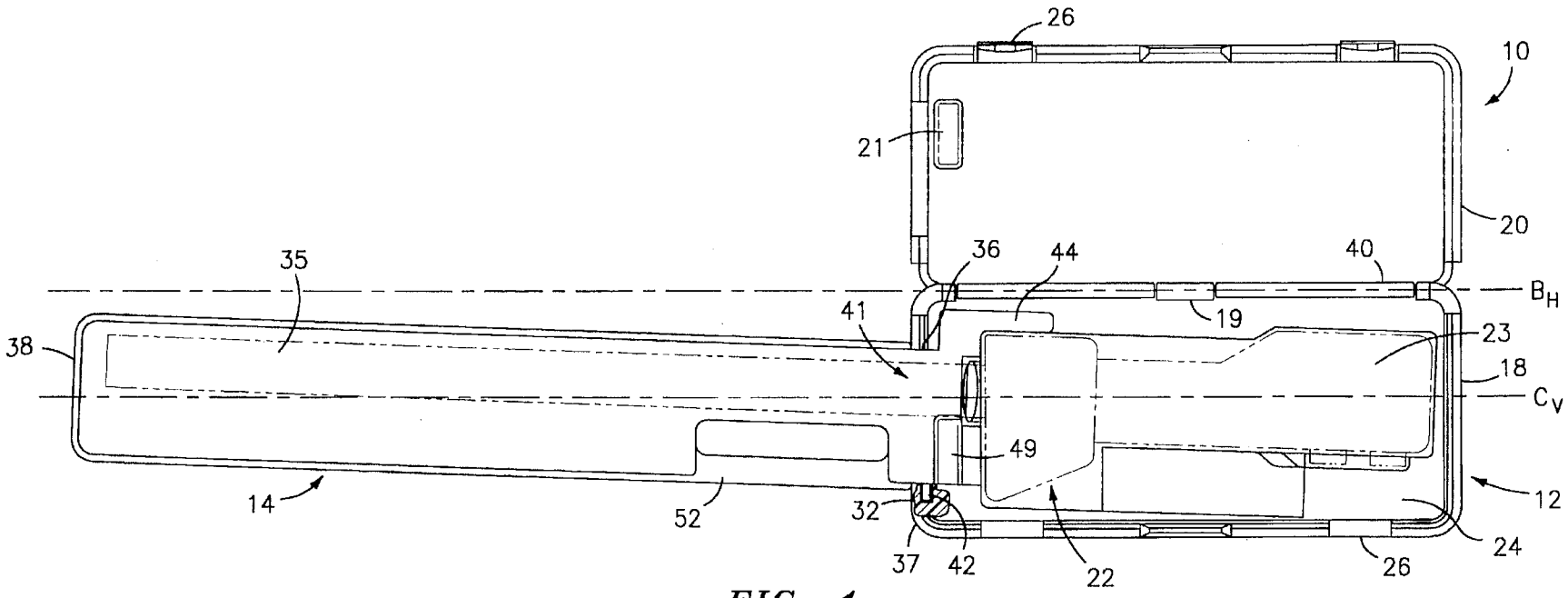
FIG. 1 is a top view of a case in accordance with the principles of the present invention, which case is shown in an open position.

Referring now to the drawings in detail, there is shown in FIG. 1 a top view of the case of the present invention, designated generally as 10. Case 10 generally includes a first containment portion 12 and a second containment portion 14.

As shown in FIG. 1, first containment portion 12 includes a base 18 and a door panel 20 hinged to base 18 for exposing an object held by the container. Door panel 20 may be hinged to base 18 in any manner known in the art, for example, the door panel may be integrally molded in a molding process with the base to include molded hinges 19 or it may be hinged through use of an externally attached hinge. Door panel 20 includes an extension 21 extending from an interior surface thereof. The extension is adapted to engage an indent on the top surface of second containment portion 14 for locking second containment portion 14 from relative movement in the closed position, as discussed further below.

Figure 2:
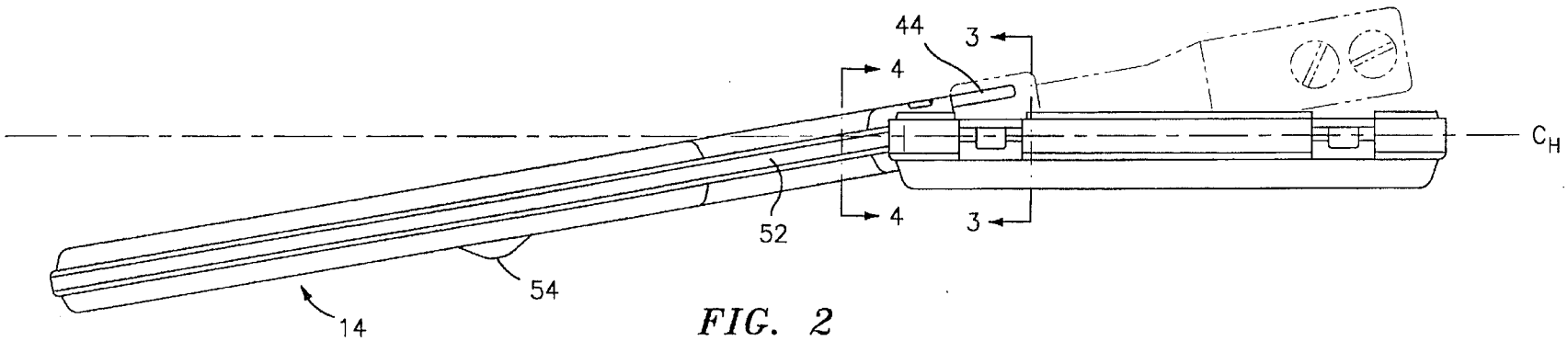
FIG. 2 is a side view of the case shown in FIG. 1.
Figure 5:
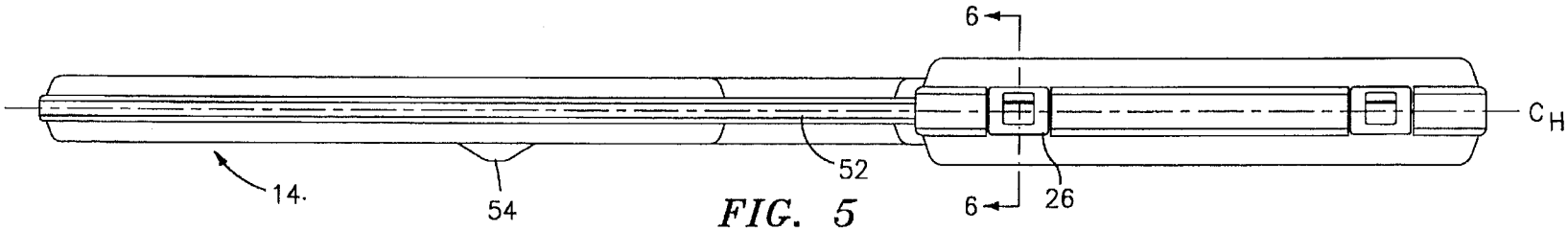
FIG. 5 is a side view similar to FIG. 2 showing the case in the closed position.
Figure 3:
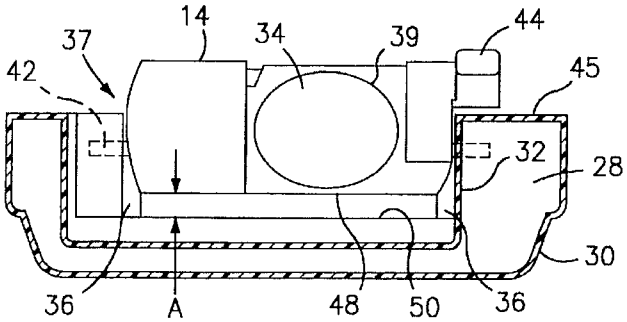
FIG. 3 is a sectional view taken through line 3—3 of FIG. 2.

Base 18 preferably has a cradle like design for receiving a main body portion 23 of an object 22, as shown in FIGS. 2 and 3. Accordingly base 18, has a cradle or receiving area 24, preferably formed in the shape of the main body portion 23, which engages and secures main body portion 23 of object 22. Base 18 and door panel 20 also preferably include co-acting locking mechanisms 26, as shown in FIGS. 1 and 5, which locking mechanisms 26 function to temporarily secure door panel 20 to base 18. Locking mechanisms 26 may be in any form known in the art but preferably are molded latches, as shown and known in the art.

As shown in FIG. 3, base 18 preferably has a double walled molded construction such that an air space 28 is preferably provided between the exterior wall 30 and interior wall 32. This double walled construction is described in greater detail in U.S. Pat. No. 3,327,841 to Schurman et al., issued Jun. 27, 1967 and is hereby incorporated by reference. The double wall construction provides a cushion for absorbing jolts to the case, via air space 28 separating the interior wall 32 from the exterior wall 30. Accordingly, the interior wall 32, which is adjacent the object 22, is protected from jolts to the outer wall via the air space, thereby also protecting the object.

Figure 4:
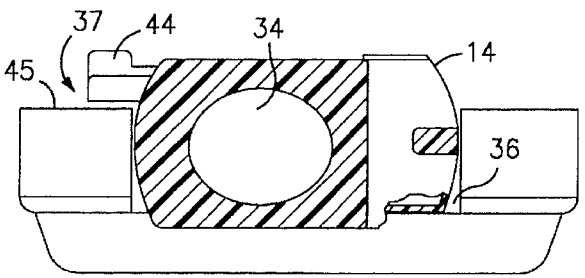
FIG. 4 is a sectional view taken along line 4—4 of FIG. 2.

Second containment portion 14, as shown in FIGS. 1–5, is typically narrower in cross-section than first case portion 12, preferably in the form of a scabbard, and is preferably formed from a single wall construction, as shown by the cross-hatch in FIG. 4. Alternatively, however, the double walled construction described above may be used. Second containment portion 14 preferably has a rectangular exterior wall cross-section and a circular interior wall cross-section defining an oversized cavity 34 which extends the length thereof. The shape of the interior wall cross-section, and accordingly, cavity 34, may be changed to accommodate the particular shape of the elongated portion 35 of object 22, shown in FIG. 1, and is oversized to assist in the removal of elongated portion 35 therefrom. The shape of the exterior wall cross-section is not critical. In this case, the object 22 has elongated portion 35 with a circular cross section and accordingly, cavity 34 is shaped as such.

The body of second containment portion 14 extends into first containment portion 12 through a slot 36 in the end 37 of first containment portion 12, as shown in FIGS. 3 and 4. As shown in the side views of FIGS. 2 and 5, second containment portion 14 extends into first containment portion 12 at substantially the center thereof, substantially on the longitudinal axis or horizontal centerline $C_H$. Referring back to the top view of FIG. 1, second containment portion 14 extends into first containment portion 12 on an angle to top or vertical centerline $C_v$, The angle is sufficiently off centerline $C_v$, toward hinges 19, preferably 2°, such that the free end 38 of second containment portion 14 lies substantially on the same plane as the hinged side support edge 40 of first containment portion 12, as indicated by the hinged edge body line, $B_H$. This arrangement allows case 10 to be rested on a support surface in a stable position with latches 26 facing upward, such that the case receives support from the entirety of hinged side edge 40 and free end 38.

Referring again to FIG. 3, second containment portion 14 includes an entrance opening 39 positioned in the interior of first containment portion 12 and extending into cavity 34. Entrance opening 39 is preferably oversized, similar to cavity 34, with respect to elongated portion 35 of object 22 so as to easily receive the elongated portion 35. In addition, for ease of insertion of elongated portion 35, entrance opening 39 is preferably non-perpendicular to the longitudinal axis of base 18. That is, entrance opening 39 is preferably at a non-perpendicular angle relative base 18, causing entrance opening 39 to face upwardly from the cradle area of base 18, as shown in FIG. 1.

As shown in FIGS. 1 and 3, end 41 of second containment portion 14 extending into slot 36 is pivotal via pivot 42 in two directions, i.e. upwardly and downwardly or in two directions sidewardly. Pivot 42 is preferably connected to the interior wall 32 of base 18 and mutually through end 41 of second containment portion 14. Pivot 42 may be of any variety known in the art including a plastic, metal or other type of pivot or the like mutually engagable with the first and second containment portions. The specific design of the pivot is not critical. Pivot 42 is preferably positioned on substantially the common horizontal centerline $C_H$, as shown by the dotted lines in FIG. 3 and as indicated by FIG. 5, of the first and second containment portions.

Via pivot 42, second containment portion 14 is pivotal through an angle relative first containment portion 12, as is shown most clearly in FIG. 2. The angle is selected to have a size such that the first and second containment portions are prevented from reaching a parallel orientation, and more preferably, the first and second containment portions are prevented from reaching a perpendicular orientation, and most preferably, the first and second containment portions are limited to reaching an orientation much less than perpendicular, as discussed below.

Figure 6:
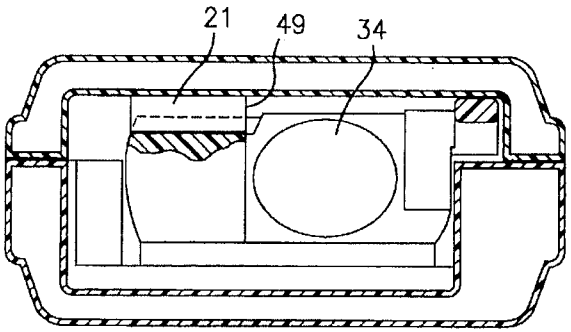
FIG. 6 is a sectional view taken along line 6—6 of FIG. 5.

Second containment portion 14 includes two mechanisms by which the pivoting thereof relative first containment portion 12 is controlled. To control the limit of upward pivotability, end 41 of second containment portion 14 includes a stop 44 extending therefrom, as shown in FIG. 1–4, which stop 44 is preferably designed to engage the top surface 45 of base 18 when second containment portion 14 is positioned on a plane substantially on line with the horizontal centerline $C_H$. Accordingly, as indicated by FIGS. 3–5, stop 44 limits the maximum relative upward pivoting position of second containment portion 14 such that second containment portion 14 lies on substantially the same centerline $C_H$ as first containment portion 12. An extension 21 extends from door panel 20 for engagement with an indent 49 formed in top surface 45 of second containment portion 14 at end 41. Accordingly, indent 49 is in alignment with extension 21 when case 10 is in the closed position of FIG. 5, and as shown in the cross section of FIG. 6. The engagement of extension 21 with indent 49 prevents second containment portion 14 from pivoting relative to first containment portion 12 while case 10 is closed.

With reference again to FIG. 3, for limiting the downward pivotability of second containment portion 14 relative first containment portion 12 while in the open position of FIG. 1, a limited clearance A is preferably provided between lower face 48 of second containment portion 14 and upper edge 50 of slot 36. The clearance A is selected such that upon limited downward pivoting of second containment portion 14, lower face 48 engages upper edge 50 thereby stopping further pivoting. The clearance has been selected to limit relative pivoting to preferably between 5° and 15°, and most preferably approximately 10°, however, this clearance can be altered or changed so as allow less or more pivot. The only critical feature in selecting the clearance and associated pivot angle is that upon the pivoting of second containment portion 14 relative first containment portion 12 downwardly, main body portion 23 of object 22 must be caused to clear cradle area 24 of base 18, as shown in FIG. 2. For selecting this clearance and related pivot angle, consideration is given to the type of object 22 being stored in the case, the thickness of main body portion 23, the extent of oversizing of cavity 34 and entrance opening 39, and the depth of cradle area 24.

As shown in FIGS. 1 and 5 second containment portion 14 also includes a handle 52 and a foot or bumper 54, each preferably molded thereon for stabilizing the container when placed on a support surface. Handle 52 is for easing the carrying of case 10 and bumper 54 is preferably used to maintain second containment portion 14 on substantially the same plane as first containment portion 12 while case 10 is resting on a rigid surface. Accordingly, bumper 54 prevents second containment portion 14 from pivoting downwardly, thus preventing main body portion 23 of object 22 from pushing upwardly on door panel 20 while case 10 is resting on the rigid surface.

Figure 7:
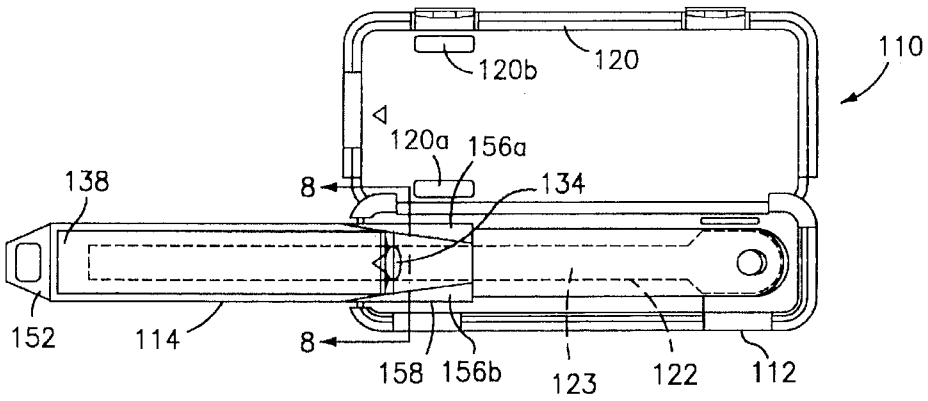
FIG. 7 shows an alternative embodiment of a case designed in accordance with the principles of the present invention.

FIG. 7 shows, as an alternative embodiment of the case shown in FIGS. 1–6, a case 110 which is preferably designed for use with a torque wrench or other object of similar proportion. The features which are not discussed in detail for the FIG. 7 embodiment are understood to be substantially the same as the similar features described above for case 10, and accordingly, the description for these features is hereby incorporated.

Figure 8:
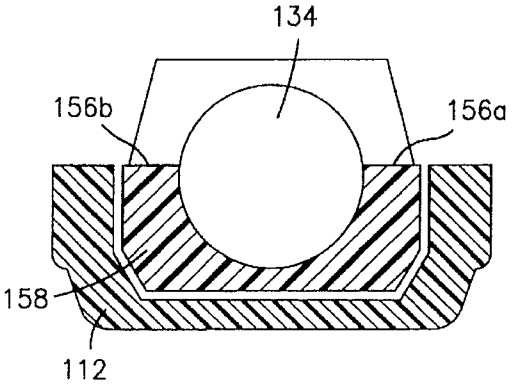
FIG. 8 is a cross-sectional view taken along line 8—8 of FIG. 7.

Case 110 includes a first containment portion 112 and a second containment portion 114 which, similar to as described above for case 10, is pivotally hinged to first containment portion 112 for easing the removal of elongated object 122 therefrom. Similar to container 10, first containment portion 112 is designed to contain body portion 123 of the object 122, and second containment portion 114 is designed to contain a substantial amount of the elongated portion of the torque wrench and is also the scabbard. Containment portion 114 also includes a loop handle 152 at end 138 thereof. As shown in FIG. 7, door panel 120 includes two extensions **121*a* and 121*b* formed thereon adapted to engage edges 156*a* and 156*b*, respectively, of portion 158 of scabbard 114, extending into containment portion 112. Portion 158 is preferably semi-circular in shape, as shown in FIG. 8, and is an extension of the lower portion of scabbard 114, beyond opening 134. The free outwardly facing edges of portion 158, therefore, form edges 156*a* and 156*b*. In this embodiment, edges 156*a* and 156*b* replace stop 44 of the FIG. 1 embodiment to prevent rotation of scabbard 114 while the case is closed. Unlike case 10, scabbard 114 of case 110 preferably does not extend into containment portion 112** on an angle, since, as this design is directed to smaller objects, the support gained from such an angular insertion, is not as necessary.

While cases 10 and 110 can be formed from any desired material, for example, plastic, metal and wood, the case of the present invention is preferably molded as a unitary article in a molding machine, from plastic. The simplified inventive structure disclosed herein allows for the economic design of the required mold as well as an economically formed article.

In use, case 10 is preferably placed in the position as shown in FIGS. 1 and 2 for the insertion of elongated portion 35 of object 22 into second containment portion 14. Once elongated portion 35 of object 22 is inserted, main body portion 23 of object 22 is pushed into cradle area 24 of base 18. Case 10 can then be placed on a rigid surface and door panel 20 may easily be closed. After closing door panel 20, co-acting locking mechanisms 26 may be latched so as to lock door panel 20 to base 18. In closing door panel 20, extension 21 is operative to press down on indent 49 of top surface 45 for maintaining second containment portion 14 in substantially the same plane as first containment portion 12, while case 10 is closed. If placed on a rigid surface, bumper 54 maintains case 10 in a substantially level orientation relative to the surface, also taking pressure off extension 21 of door 20.

Upon opening door panel 20 as shown in FIG. 1, object 22 may be removed from case 10 in the same manner as it was inserted, as shown in FIG. 2. Accordingly, second containment portion 14 is preferably moved to an unsupported position where second containment portion 14 can be pivoted relative first containment portion 12 via pivot 42. Upon moving second containment portion 14 relative first containment portion 12, and specifically end 41 away from cradle area 24 at end 37, object 22 is also moved out of cradle area 24. Accordingly, main body portion 23 of object 22 is moved to an angle relative base 18 by being pivoted upwardly until the outer most end of the main body portion is cleared for removal from base 18. After pivoting as shown in FIG. 2, object 22 can then be removed from case 10. As is obvious from this description, insertion and removal of the elongated portion 35 of object 22 is accomplished without the use of a hinged door panel with the second containment portion. Such an arrangement allows for less material to be used and a less complex mold to be developed for the case.

The cases shown can be used with a variety of elongated objects such as rifles, metal detectors, torque wrenches, etc., which objects generally have a main body portion and an elongated portion.

The primary advantage of this invention is that a case is provided for protectively housing elongated objects, which case allows for the easy removal of an elongated portion of the object therefrom. Another advantage of this invention is that a case for elongated objects is provided, which case allows for the easy removal of elongated body portions of objects therefrom while having a design for minimizing costs generally associated with molding such cases. Still another advantage of this invention is that an elongated case is provided having two relatively movable containment portions so as to allow for easy removal of an elongated body portion of an object therefrom. And still another advantage of this invention is that a case for elongated objects is provide which case includes one containment portion for receiving the main body portion of an object and another containment portion for receiving an elongated body portion of an object, wherein only one of the containment portions includes a hinged door panel for exposing the object.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A case for holding an object, comprising:

a first containment means for containing at least a first portion of said object, said first containment means including means for exposing at least the first portion of said object;

a second containment means for containing at least a second portion of said object; and wherein said containment means are relatively pivotal in a first and second direction, further including means for limiting the extent of relative pivotal movement between said first and second containment means, wherein said means for limiting comprises first means for stopping pivoting in said first direction and second means for stopping pivoting in said second direction.

2. The case according to claim 1, wherein said first containment means includes a cradle area for holding the first portion and said second containment means includes a cavity for receiving the second portion.

3. The case according to claim 2, wherein said second containment means is hinged to said first containment means such that upon relatively pivoting said first and second containment means, the first portion is freed from said cradle area and the second portion is removable from said cavity.

4. The case according to claim 3, wherein said cavity of said second containment means is elongated for receiving an elongated second portion.

5. The case according to claim 4, wherein said cavity is oversized for loosely receiving the elongated second portion.

6. The case according to claim 3, wherein said cavity includes an entrance opening at an open end of said second containment means, and wherein said second containment means extends into said first containment means such the said entrance opening is positioned in said first containment means.

7. The case according to claim 6, wherein said case has an object removal position and an object securing position and wherein said first containment means has a longitudinal axis, said opening non-perpendicularly oriented with respect to said longitudinal axis while said case is in said object securing position.

8. The case according to claim 7, wherein said opening faces away from said cradle area and said opening is oversized with respect to the object.

9. The case according to claim 1, wherein said first containment means has a double walled construction.

10. The case according to claim 1, wherein said second containment means is elongated with respect to said first containment means.

11. The case according to claim 1, wherein said first containment means comprises a door and a base, said means for exposing comprising said door being hinged to said base for exposing the first portion.

12. The case according to claim 1, wherein said case has an open and a closed position, further comprising means for substantially preventing said first and second containment means from relatively pivoting while in said closed position.

13. The case according to claim 12, wherein said means for substantially preventing comprises said means for exposing including an extension which engages a surface of said second containment means.

14. The case according to claim 13, wherein said means for exposing comprises a hinged door having an interior surface and an exterior surface, said extension extending from said interior surface.

15. The case according to claim 14, wherein said surface includes an indent for engaging said extension.

16. The case according to claim 1, wherein said first containment means includes an slot and said second containment means extends into and is pivotal in said slot, said first and second containment means defining a clearance through which said first and second containment means are pivotal, and wherein said first means for stopping comprises said second containment means and said first containment means engagable after movement through said clearance.

17. The case according to claim 16, wherein said clearance has a size such that when said first and second containment means are pivoted, said object is moved out of said first containment means an amount allowing for removal of said object.

18. The case according to claim 1, wherein said second means for stopping comprises a stop extending from said second containment means and positioned in said first containment means, wherein upon reaching maximum pivot in said second direction, said stop is engagable with a surface of said first containment means.

19. The case according to claim 1, wherein said first and second containment means share a substantially common longitudinal axis, and wherein said first and second containment means are relatively pivotal via a pivot point substantially intersecting said common longitudinal axis.

20. The case according to claim 1, further comprising means for stabilizing when positioned on a flat surface.

21. The case according to claim 20, wherein said means for stabilizing comprises a foot extending from said second containment means.

22. The case according to claim 1, wherein said case has an open and closed position and wherein said first containment means has a vertical centerline, said second containment means connected to said first containment such that said second containment means is positioned on an angle relative said vertical centerline in each of said closed and open positions.

23. The case according to claim 22, wherein said first containment means has a support edge and said second containment means has a free end, wherein upon placement of said support edge in substantially full contact with a support surface, said support edge and a portion of said free end lie in substantially the same plane.

24. The case according to claim 22, wherein said case has an open and closed position and wherein said first containment means has a horizontal centerline, said second containment means connected to said first containment such that while in said closed position, said second containment means substantially shares said horizontal centerline with said first containment means.

25. The case according to claim 1, including means for preventing said first and second containment means from reaching a substantially parallel orientation.

* * * * *